US006062466A

United States Patent [19]

Itey

[11] Patent Number: 6,062,466

[45] Date of Patent: May 16, 2000

[54] FOLDING BOX FOR PRODUCTS SUCH AS PASTRIES AND CAKES

[75] Inventor: Frederic Itey, 8, rue des Oiseaux, 91130 Ris/Orangis, France

[73] Assignees: Frederic Itey, Ris/Orangis; Pierre Herrburger, Paris, both of France; part interest to each

[21] Appl. No.: 09/300,506

[22] Filed: Apr. 28, 1999

[30] Foreign Application Priority Data

Apr. 29, 1998 [FR] France ..... 98 05376

[51] Int. Cl.[7] ..... B65D 5/00

[52] U.S. Cl. ..... 229/103.3; 229/117.14; 229/157

[58] Field of Search ..... 229/103.3, 117.14, 229/117.15, 157, 902

[56] References Cited

U.S. PATENT DOCUMENTS

| | | | |
|---|---|---|---|
| 1,296,760 | 3/1919 | Bueschel | 229/117.14 |
| 2,805,019 | 9/1957 | Muhs et al. | 229/117.15 |
| 3,377,015 | 4/1968 | Moreno | 229/117.14 |
| 4,307,834 | 12/1981 | Roccaforte | 229/117.14 |
| 5,042,715 | 8/1991 | McNeill | 229/117.15 |
| 5,423,478 | 6/1995 | Roosa | 229/117.14 |

FOREIGN PATENT DOCUMENTS

| | | | |
|---|---|---|---|
| 1392029 | 2/1965 | France | 229/117.14 |
| 283612 | 10/1952 | Switzerland | 229/117.14 |
| 533718 | 2/1941 | United Kingdom | 229/117.14 |
| 889718 | 2/1962 | United Kingdom | 229/117.14 |

*Primary Examiner*—Gary E. Elkins
*Attorney, Agent, or Firm*—Seidel, Gonda, Lavorgna & Monaco, PC

[57] ABSTRACT

A folding box for products such as pastries and cakes comprises a base which receives the product to be packaged and which is bordered by two main flaps and two secondary flaps. Each main flap is extended by a limb connected to the body of the flap by a folding line forming an articulation. Two slits are cut into each main flap and straddle the folding line. Each secondary flap terminates in a locking strip having a head and two side notches for entering the slits.

10 Claims, 7 Drawing Sheets

FOLDING BOX FOR PRODUCTS SUCH AS PASTRIES AND CAKES

The present invention relates to a folding box for products such as pastries and cakes.

There are already a large number of versions of folding boxes which are used for packaging relatively fragile products, such as pastries, which are transported over short distances, and which are generally held in the hand in a suspended position, that is to say, held in the hand preferably hooked for safety over a finger passing through an opening formed in a limb or limbs, especially according to document GB 533 718 (Robinson) or document U.S. Pat. No. 2,151,733 (Bonfield).

Although the known boxes are generally satisfactory and even of great value for packaging some products, they have the disadvantage of being limited in size because they require a relatively large basic surface area in order to cut out the blank from which the boxes are made. In addition, some boxes are practically impossible to produce economically for products of some length, such as, for example, log cakes. Finally, current techniques for cutting out and assembling boxes do not permit the production of boxes inspired by the tall, pyramidal shape of a so-called "made-up" pack, which is currently produced from paper.

The present invention proposes to overcome the disadvantages of the known solutions and proposes to produce a folding box which takes up little space when empty, that is to say, in the non-made-up state, using a very small surface area of cardboard or more generally sheet-form material, permitting the production of relatively long boxes, the assembly of which by the user is as simple and efficient as possible and which are not at risk of opening accidentally regardless of the actions of the person carrying the loaded box.

To that end, the invention relates to a folding box of the type defined above, characterised in accordance with the characterising portion of the first claim.

The box according to the invention offers the advantage that the secondary flaps, that is to say, two of the four flaps, which are opposite one another and form the side walls and the top of the box, define very generally the cross-section of the box, that is to say, the shape of the internal volume available for receiving the product to be packaged. The secondary flaps have a form scarcely larger than the cross-section of the box, which is of particular value in the production of elongate boxes, for example boxes receiving log cakes, because, in that case, and unlike some known boxes, the end flaps or outer flaps according to the invention do not have to have an extremely great length which would be practically double the length of the base. Instead, as in the case of the packaging of such "tubular" products having a relatively small cross-section, the surface area of material for producing the end flaps will be extremely small and, overall, the surface area of the material blank from which the box is cut will be only slightly larger than the envelope of such an elongate product.

Owing to the locking by traction, effected between the main flaps and the side flaps, it is easy to give the box according to the invention the form of a made-up pack, that is to say, a relatively tall, substantially pyramidal shape. Despite the relatively great height, the locking of the box cannot be undone accidentally because, under the effect of traction, that is to say, under the effect of the load of the products in the packaging, which is exerted on the base of the box, the main flaps are pulled downwards, which causes the slits to be placed against the notches while the heads of the locking strips are prevented from becoming disengaged from the notches. Furthermore, when the pack is set down, the resilience of the material and the opposing forces created between the main flaps and the secondary flaps which act as bracing members prevent the locking strips from becoming disengaged from the notches.

The box according to the invention is made up in a very simple manner. In general, the box is supplied in the preassembled state, that is to say, with the limbs constituting the handles adhesively bonded over their entire surface or at least in a region bordering the folding line between the limbs and the body of the flap. The adhesive bonding prevents the angle between the flaps from opening and possibly releasing the locking strips. When the box is thus supplied in the adhesively bonded state, folded in accordance with its plane of symmetry parallel to the main flaps, the user simply opens the box by placing the base flat in order to introduce the products to be packaged, the secondary flaps likewise being unfolded and placed flat. Once the products have been loaded onto the base, it is necessary only to bend one of the secondary flaps and to introduce its locking strip into the double locking slit thus formed in the handle by combining the homologous slits of the two assembled limbs forming the handle. This positioning is very simple because it is necessary only to squash the main flaps slightly to place in a practically horizontal position the two portions of the slit belonging to the body of the main flaps. Those two portions offer the maximum opening in terms of width, which enables the head of the locking strip to be introduced. It is necessary only to release the slight pressure thus exerted in order for the resilience of the material to cause the handle to rise and narrow the slit again by the flap body, to reclose on the strip head and to hang the notches of the locking strip against the end of the slit.

The positioning of the strip of the second secondary flap is carried out in the same manner.

According to a further advantageous feature of the invention, the main and secondary flaps are symmetrical in pairs.

That situation corresponds to the most general case of a box having a square or rectangular base which is extended either along the axis of symmetry (or the plane of symmetry) or perpendicularly to that plane.

In an especially advantageous manner, especially when the box is symmetrical, and if the limbs are already adhesively bonded as far as the folding line, it is advantageous for the box, in the state in which it is not opened out, that is to say, not yet used, to be folded along a folding line corresponding to the axis of symmetry of the blank. The folding operation concerns the base and the two secondary flaps. However, the folding operation has no importance later on when the box is opened out because the edge of the dihedron, which edge is constituted by the respective folding line, stiffens the assembly and the sheet of material in such a manner that the cardboard can bend only in accordance with a cylindrical shape generated by a generatrix parallel to the edge of the dihedron. The box is thus completely stabilised.

The cuts made in the secondary flaps permit the partial introduction of a finger for retaining or pushing and guiding the end of the secondary flap in order to introduce the locking strip more readily into the slit formed by the two homologous slits of the two main flaps, in the region of the folding edge of the limbs, while the two flaps are pressed in slightly in order to bring the slit portion into a more or less horizontal position.

The present invention will be described hereinafter in more detail with reference to the appended drawings in which:

FIG. 1 is a perspective diagrammatic view of a first embodiment of a folding box according to the invention, FIG. 2 is a plan view of the cut-out blank from which the box according to FIG. 1 is produced, FIG. 3 is a side view of the box showing the cross-section thereof, FIG. 4 is a detailed view of the box at the region of the folding line between the limb and the body of a flap with the locking strip of a secondary flap in position, FIGS. 5A, 5B show the two stages of introducing the locking strip into the double slit of the main flaps, FIG. 6 is a partial view analogous to FIG. 2 to another embodiment of the invention, FIG. 7 shows a variant of FIG. 6, FIG. 8A is a simplified diagram of the limb of a flap according to FIG. 6, FIG. 8B is a side view of the head of a secondary flap according to FIG. 6, folded for positioning in the slit of the main flap of FIG. 8A.

According to FIG. 1, the invention relates to a folding box represented in the made-up state. The box is composed of a rectangular base FD which is, for example, square or even very elongate and which is provided with side walls formed by two main flaps VP1, VP2 bordering the base FD along two sides constituting folding lines LP1, LP2. The main flaps VP1, VP2 each terminate in an end in the form of a limb P1, P2, each of which is preferably produced with an opening O1, O2. The limbs are connected to one another and their folding lines LP11, LP12, connecting the limbs to the bodies of the flaps, are superposed on one another in order to constitute the base of the handle used to hold the box in a suspended position.

The other two sides of the box are closed by secondary flaps VA1, VA2 which are connected to the base FD by respective folding lines LP3, LP4; at the upper portion, they are connected to the main flaps VP1, VP2 by a locking connection described in more detail hereinafter.

The shape and the structure of the box will become clearer on examining the cut-out blank used to produce the box. The blank is shown in FIG. 2.

The blank is composed of a rectangular or square base FD bordered by the two main flaps VP1, VP2 and the two secondary flaps VA1, VA2. Each main flap VP1, VP2 is composed of a flap body CV1, CV2 which continues in a limb P1, P2 connected to the flap body by a respective folding line LP11, LP12. The limbs P1, P2 are provided with openings O1, O2 which are, for example, round.

Straddling the folding lines LP11, LP12, there is, in each flap VP1, VP2, a first slit F11, F21 and a second slit F12, F22. The slits and the folding lines of the two flaps VP1, VP2 are in homologous, superposable positions to form supports. In general, the flaps VP1, VP2 have an identical and especially symmetrical shape.

The secondary flaps VA1, VA2 terminate, on the outside, in a locking strip LV1, LV2 having a head T1, T2 and, below that head, two abutments in the form of notches E11, E12, E21, E22.

According to one variant, a respective cut DC1, DC2, which delimits an opening which can be formed by pressing a flap delimited by the cut into the surface of the blank, is provided below the locking strips LV1, LV2. An opening or a limb is thus formed which enables the secondary flap VA1, VA2 to be held close to the locking strip in order to facilitate and assist the positioning of that strip as will be seen hereinafter.

According to a preferred embodiment, FIG. 2 shows that the blank has an axis of symmetry XX which can also constitute a main folding line LPP. The blank can be stored and supplied in the state folded about the folding line LPP, the main flap VP1 coming over the main flap VP2 and the secondary flaps VA1, VA2 being folded in half on themselves, as are also the other portions, such as the locking strips and the base FD.

In the case where the box is presented adhesively bonded in the state folded along the folding line XX, when the box is opened out, the dihedrons, which have as their tops the folding lines LP3, LP4 and which are formed by the base FD and each of the secondary flaps VA1, VA2, stiffen the assembly with, on each side, an edge stiffening the base FD which can no longer be folded along the line LPP. The edges at LP3, LP4 also stiffen the flaps VA1, VA2 which can now be deformed only in accordance with a cylindrical surface of a generatrix parallel to the line LP3 or LP4.

The box can also not be preassembled by the limbs P1, P2. In that case, it is worth pre-pasting one or both limbs on the assembly surfaces and covering the pasted surface with a peel-off anti-adhesive sheet, adhesive bonding then being effected by the user at the time when the box is used. The cut-out blank can nevertheless be folded especially about the axis (plane) of symmetry so that it takes up less space when stored.

FIG. 2 also shows two vertical dotted lines Y1Y1 and Y2Y2 passing substantially behind the slits F11, F21 and F12, F22. The lines Y1Y1, Y2Y2 define very roughly two outer regions of width 11, 12 and an intermediate region of width 1i. That demonstrates that, according to the invention, it is possible to choose any length for the base FD (sum of the lengths 11, 1i, 12) to obtain a range of boxes all having the same form, in the region of the ends, that is to say, the portions arranged, respectively, to the right of the line Y1Y1 and to the left of the line Y2Y2, by lengthening the intermediate region (length 1i). This shows especially that, in the case of very long products, use is made of the same form of blank, that is to say, the same form of cut-out from the sheet of material, such as cardboard, with the same contour and the same forms of slits, notches, etc. . . . , simply by lengthening the intermediate portion 1i.

It will be appreciated that, for reasons of strength, the openings O1, O2 are not involved in this lengthening even if overall the limbs P1, P2 are thus lengthened. FIG. 2 also shows that it is possible to produce very different forms of box. The folding lines LP1, LP2 are not necessarily parallel but they must be symmetrical relative to the axis XX as must the folding lines LP11, LP12 for defining the common base line or folding line of the limbs P1, P2 for the assembly and locking of the locking strips in the slits F11, F12, F21, F22 which must also always be superposable, that is to say, symmetrical relative to the axis XX.

Likewise, the secondary flaps VA1, VA2 are not necessarily symmetrical relative to a perpendicular to the axis XX. The flaps can have different forms depending on whether the main flaps are themselves symmetrical relative to such as axis or not, when the folding lines LP1, LP2 are not parallel.

The flaps VA1, VA2 are each symmetrical relative to the axis of symmetry XX but their dimensions are not necessarily identical, nor is the shape of their contour, and thus, in a general manner, the base FD is defined by a quadrangle which, in the majority of cases, is a rectangle going as far as a square or a rectangle extended in the direction perpendicular to the line XX, the only condition being that the folding lines of the limbs P1, P2 and the slits correspond to one another to receive, by locking, the locking strips at the end of each of the secondary flaps.

The locking operation will be described hereinafter with the aid of FIGS. 4, 5A, 5B.

FIG. 3, which is a view of an assembled box seen from the side, shows the shape of the cross-section constituted by the side flap VA1 (VA2) which is placed at least partially between the main flaps VP1, VP2 and shows products PR placed inside the volume so defined.

In general, the secondary flaps VA1, VA2 are arranged between the main flaps VP1, VP2 and constitute a spacer member defining the cross-section. It is also possible for the secondary flaps VA1, VA2 to be on the outside, against the contour of the main flaps VP1, VP2, but on only one portion of the sides of those flaps VP1, VP2, starting from the respective folding line LP3, LP4; in the upper portion, before the locking strip LV1, LV2 (FIG. 2), the secondary flaps VA1, VA2 again penetrate into the gap between the main flaps VP1, VP2, so that the strips can pass into the slits. In no case is there a risk of crushing the products by excessive traction on the secondary flaps VA1, VA2 because most of the tractive force is exerted on the flaps VP1, VP2 and the secondary flaps transmit only a portion of the tractive force.

FIG. 4 is a perspective view of the detail of the locking of the head T1 of the secondary flap VA1 hidden by the flap body CV1.

This Figure shows the form of the slit F11 and the two portions of that slit which has received the head T1, with the notch E11 abutting the end of the slit. The other portions of the box are not shown, in particular the second main flap with its limb.

FIGS. 5A, 5B permit a better understanding of the manner in which the locking is effected. Each of the two Figures shows only the half, viewed in section, corresponding to the main flap VP1, to its flap body CV1 and to its limb P1; the other portions, arranged symmetrically, can be readily imagined. The same applies to the secondary flap VA1 and its head T1, only half of which is shown, to the left of the vertical plane ZZ constituting the plane of symmetry.

FIG. 5A shows that the head T1 has a half-width, starting from the plane ZZ, of b1 and a height of b2. The height is taken starting from the notch E11 located beneath the head T1. The slit F11 is divided into two portions, one of length a1 located in the flap body CV1, and the other of length a2 located in the limb P1.

In FIG. 5A, the flap body CV1 is practically horizontal, relative to the articulation represented by the folding line LP11. The length a1 of the slit F11 is greater, but only slightly, than the half-width b1 of the head T1 so that the head can pass through that portion of the slit F11 when the main flap and above all the flap body CV1 is squashed in the direction of arrow A and is practically horizontal.

Then, when the pressure is released (FIG. 5B) the natural resilience causes the limb P1 to rise in the direction of arrow B and causes the flap body CV1 to pivot very roughly about the folding line LP11. The end of the slit F11 then approaches the plane ZZ as a result of that pivoting movement. That reduces the spacing relative to the plane, which is now only a0. The spacing corresponds to the spacing of the base of the notch E11 relative to the plane ZZ. That position corresponds to the locking position because the head T1 is caught in the notch E11 which has now been closed again. It should be emphasised again that this movement is symmetrical and that the same closing-up necessarily occurs to the right of the plane ZZ in the case of the flap body CV2 (not shown) because the limbs P1, P2 are rendered unitary, at least over a given height starting from the folding line LP11.

A second embodiment and a variant will be described hereinafter with reference to FIGS. 6 to 8B. In those Figures, the same references as in the embodiment described above will be used to designate identical elements. The variants will have similar references.

The description will be limited to the description of the modifications.

According to FIG. 6, the slits F210, F220 for receiving the head T10 of the secondary flap VA1 comprise a support constituted by a step forming an edge F211, F221 and the head T10 is constituted by two portions T11, T12 connected to one another by a folding line E120. The portion T12 is folded about that folding line and its free edge E110 then constitutes the side abutment via which the head T10 introduced into the slit F210 is supported and locked against the edge F211.

According to the variant of that embodiment shown in FIG. 7, the head T10 has a smaller width but its structure with the portion T13 connected to the flap VA1 and the portion T14 connected to the portion T13 by the folding line E120, has exactly the same function as above. It is introduced into and rests in the slit F210 and on the step F211.

FIG. 8A shows the portion T12 of the head, in the folded position, and resting via its edge E110 against the edge formed by the step F211.

The folding of the portion T12 (or T14) relative to the portion T11 (or T13) about the folding line E120 is indicated by the arrow.

Figure 8A:
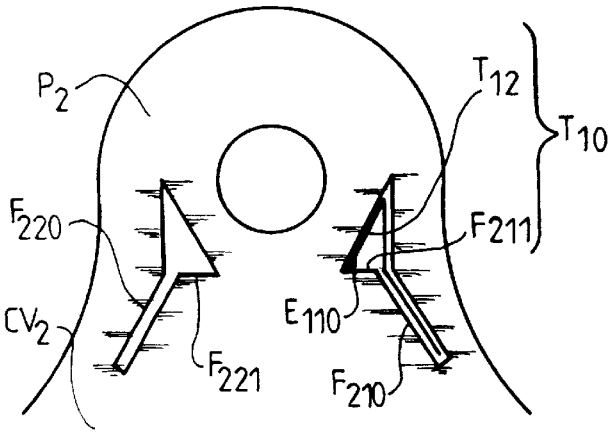
FIGS. 8A and 8B show in a more detailed manner the arrangement of the hooking of the head of the secondary flap in the slit of the main flap.
Figure 8B:
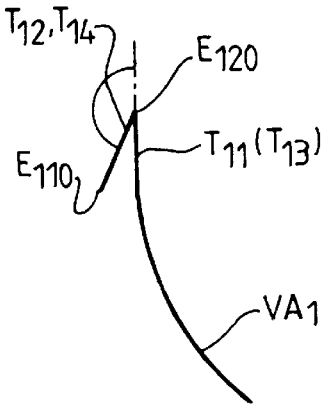

The positioning of the head T10 in the slit F210 is effected by simple introduction, the fold E120 constituting the front edge facilitating that introduction. As the portion T12 is articulated resiliently about the folding line E120 on the portion T11, it naturally has a tendency to open and place itself in the position represented in FIG. 8A in order to rest on the edge F211.

Conversely, in order to open the box, it is necessary only to pinch the portion T12 which projects beyond each side of the limb P2 in order to press it against the portion T11 and thus to unlock its support via the edge E110.

Figure 1:
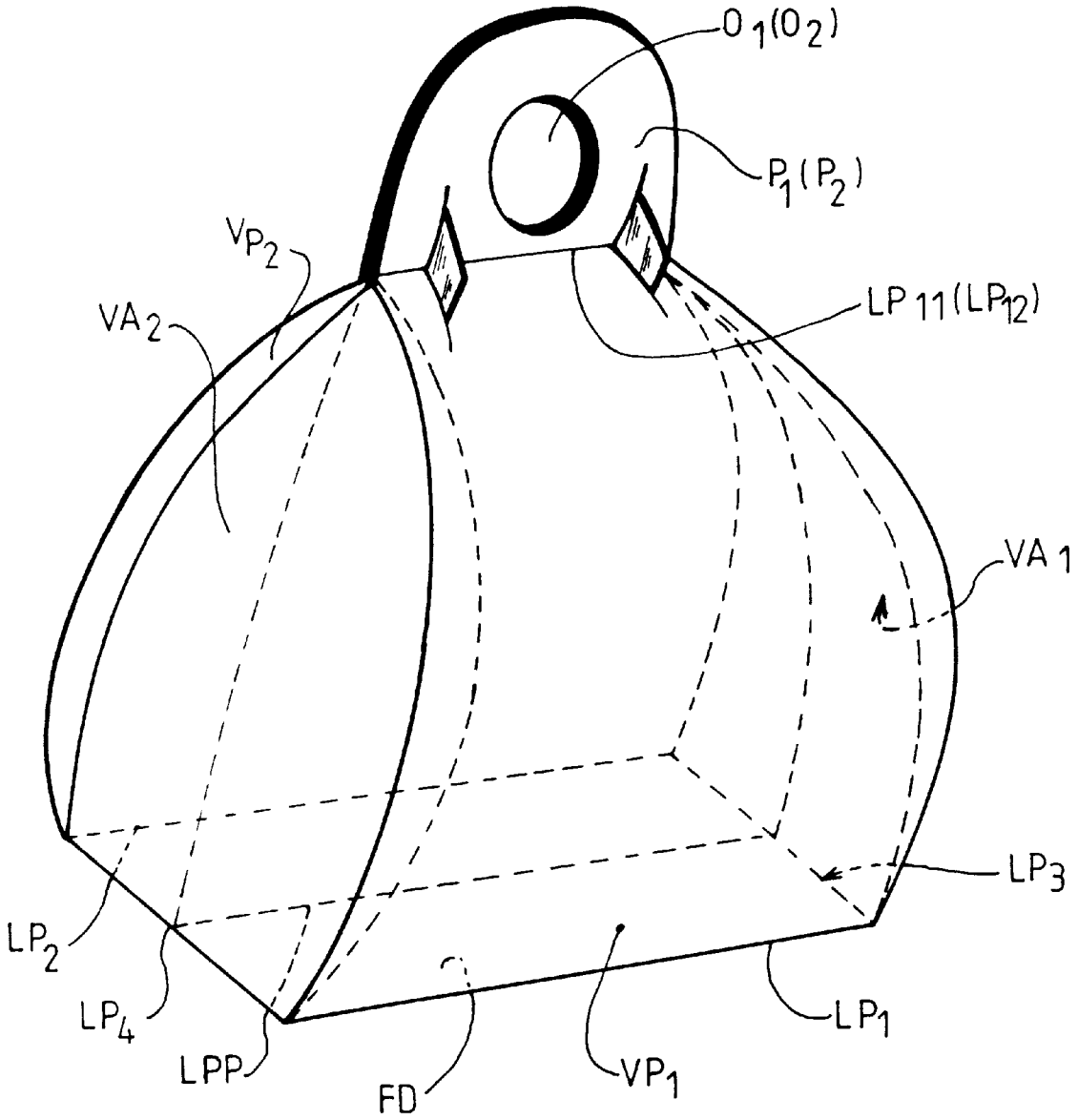
Figure 2:
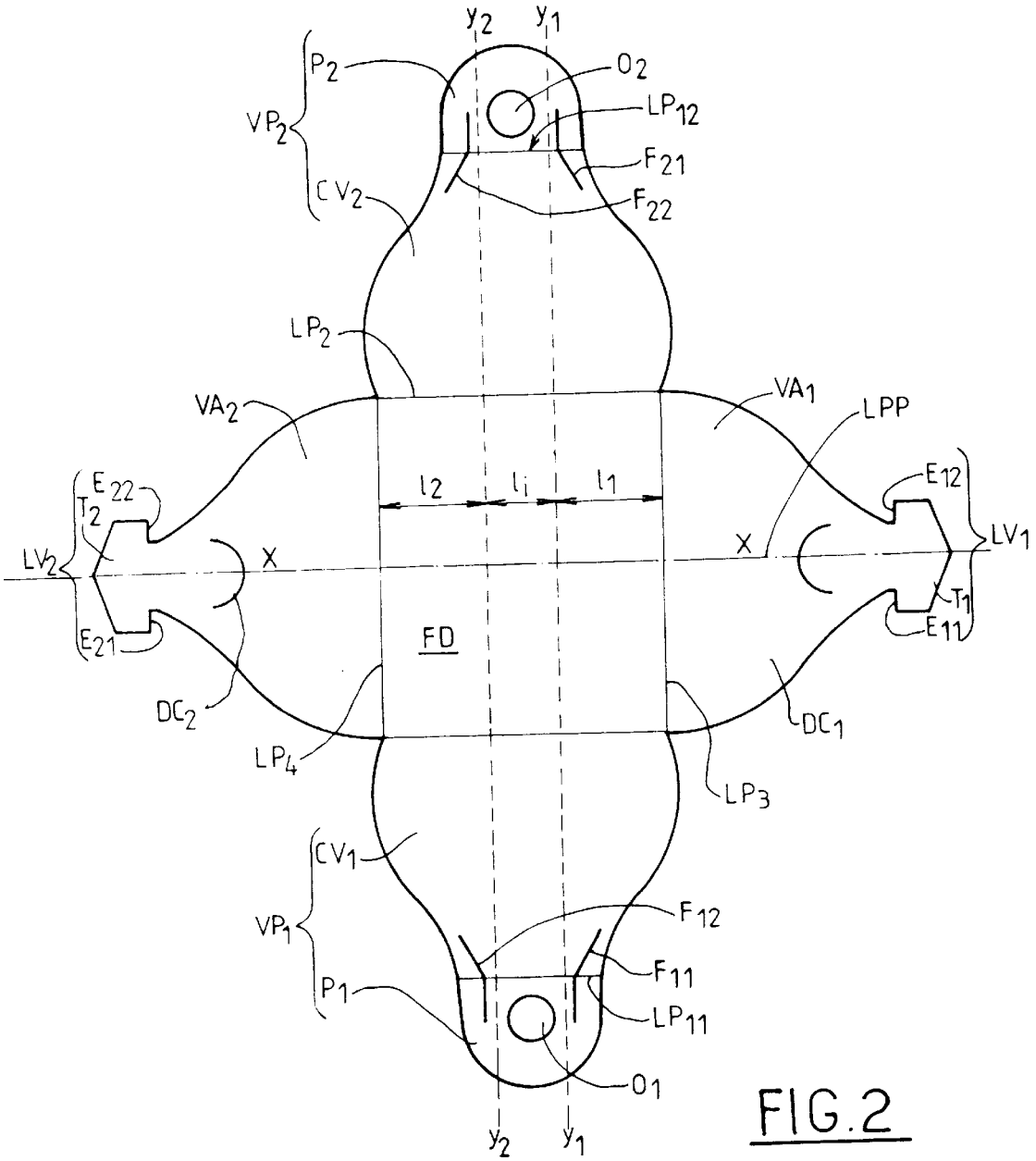
Figure 3:
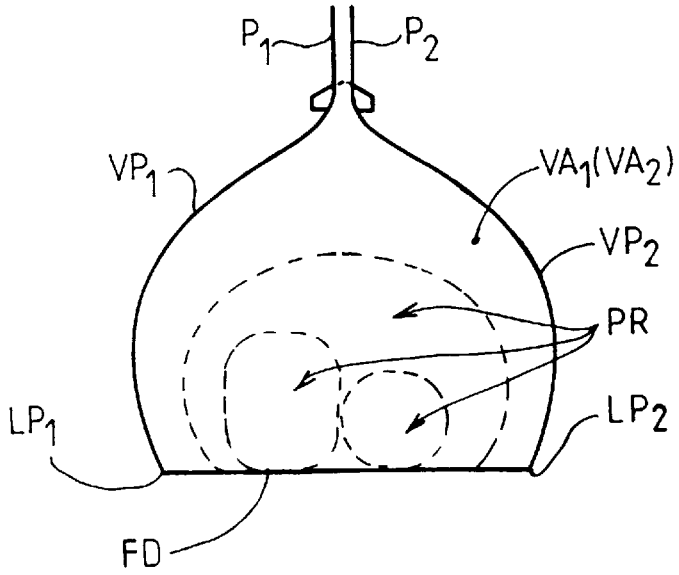
Figure 4:
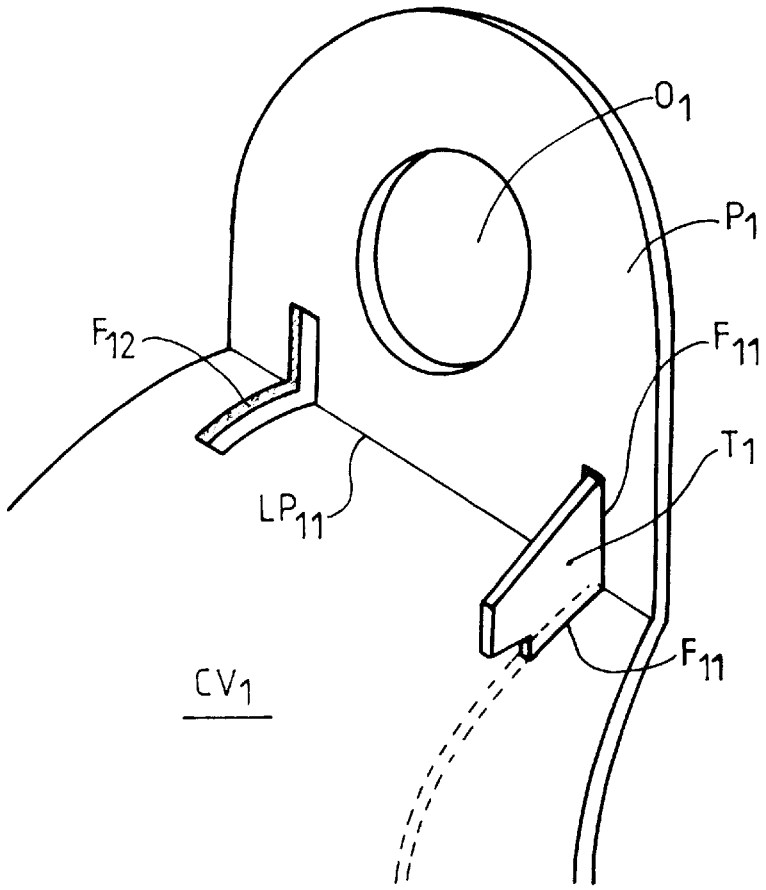
Figure 5A:
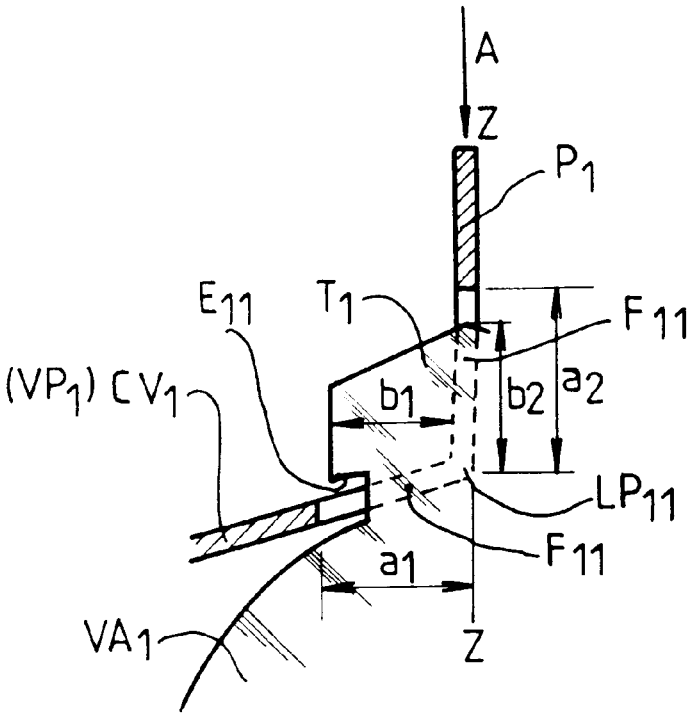
Figure 5B:
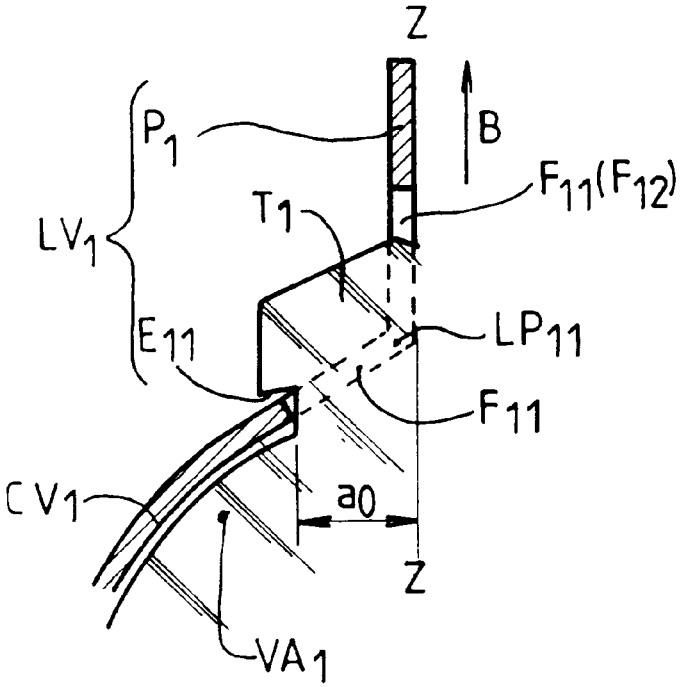
Figure 6:
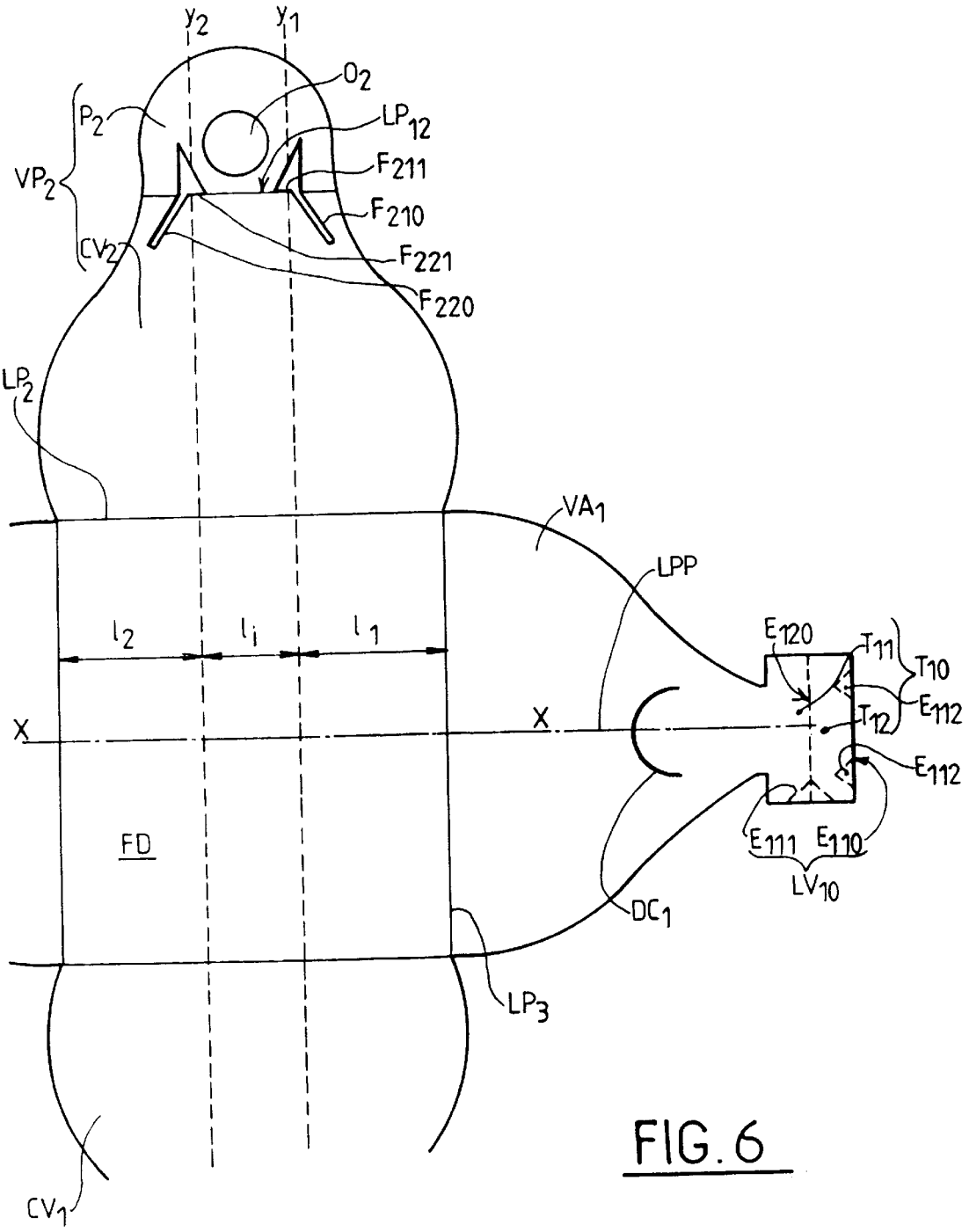
Figure 7:
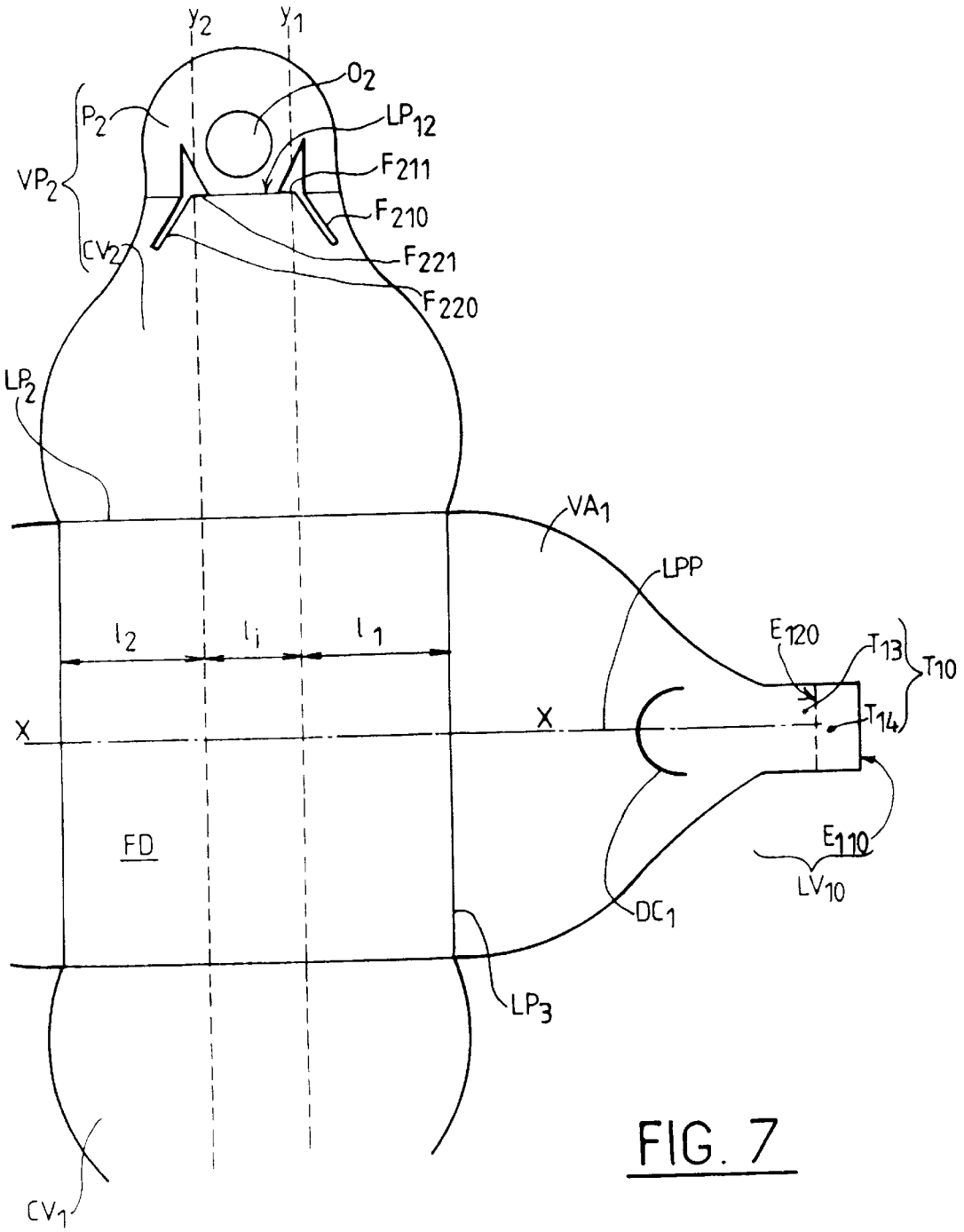

In order to facilitate introduction, it is possible to provide a slanting cut E111 (FIG. 6) on each side of the folding line E120 to give the head, in the region of the folding line E120, a smaller width which, in some cases, facilitates introduction into the slit P210. (That variant is represented on only one side of the head.)

It should be noted that the embodiment described above for a main flap VP2 and a secondary flap VA1 applies under the same conditions to the other two flaps of the box.

The boxes are preferably produced from more or less pliable cardboards provided with a coating, decoration or printing.

We claim:

1. Folding box for products such as pastries and cakes, comprising:

a base which receives the product to be packaged and which is bordered by four flaps articulated to the base and foldable over the product to form the side walls and the top of the box, two opposing flaps constituting a handle for holding the box, characterised in that it comprises:

A) two main flaps and two secondary flaps,

B) each main flap (VP1, VP2) is extended by a limb (P1, P2) connected to the body (CV1, CV2) of the flap (VP1, VP2) by a folding line (LP11, LP12) forming an articulation, a first and a second slit forming supports (F11, F12, F21, F22, F210, F220) being cut in each flap, straddling the folding line (LP11, LP12) and having a portion of length (a1) in the body (CV1, CV2) of the main flap (VP1, VP2) and a portion of length (a2) in the limb (P1, P2), the first and the second slits of the two main flaps (VP1, VP2) being superposable when the flaps are placed against one another by way of their limbs (P1, P2) and the folding lines (LP11, LP12) coincide, the limbs (P1, P2) of the two main flaps (VP1, VP2) being rendered unitary with one another at least above and as far as the folding line (LP11, LP12), C) each secondary flap is defined by its side contour, by cooperation with the two main flaps (VP1, VP2), the cross-section of the box and each secondary flap (VA1, VA2) terminates in a locking strip (LV1, LV2) having a head (T1, T2) and two side abutments (E11, E12, E21, E22, E110), D) the length of the portion (a1) of each of the two slits of the two main flaps (LP1, LP2) is substantially equal to the half-width (b1) of the head (T1, T2) of the locking strip (LV1, LV2) of the corresponding secondary flap (VA1, VA2) and the length of the portion (a2) of each slit (F11, F12, F21, F22) is equal to or greater than the height of the head (T1, T2) of the corresponding secondary flap (VA1, VA2), E) the box is assembled by joining and rendering unitary the two main flaps (VP1, VP2) in the region of their limbs (P1, P2), above the respective folding line (LP11, LP12), then by folding each of the secondary flaps (VA1, VA2), passing its locking strip between the portion of the flaps (VP1, VP2) below the folding line (LP11, LP12) and introducing the locking strip (LV1, LV2) into the respective slit (F11, F21; F12, F22).

2. Folding box according to claim 1, characterised in that the side abutments (E11, E12, E21, E22) are notches.

3. Folding box according to claim 1, characterised in that the side abutments are formed by the free edge (E110) of a portion (T12, T14) of the head (T10), folded about a hinge (E120) connecting that portion (T12, T14) to the main portion (T11, T13) of the head (T10).

4. A folding box according to claim 1, wherein the slits forming the supports comprise a step constituting a support for the edge of the folded portions of the head introduced into each slit.

5. Folding box according to claim 1, characterised in that the base (FD) is a quadrangle which is symmetrical relative to an axis (XX), especially a rectangle and in particular a square.

6. Folding box according to claim 1, characterised in that the main and secondary flaps (VP1, VP2, VA1, VA2) are symmetrical in pairs.

7. A folding box according to claim 1, wherein the box comprises a folding line (LPP) which corresponds to the axis of symmetry (XX) of the blank forming the box and which passes through the secondary flaps (VA1, VA2).

8. Folding box according to claim 6, characterised in that the blank is presented, before the box is opened out, in the flat state, folded about its main folding line (LPP), and the two limbs (P1, P2) of the main flaps (VP1, VP2) are adhesively bonded to one another at least partially above the folding line (LP11, LP12).

9. Folding box according to claim 1, characterised in that the secondary flaps (VA1, VA2) comprise a cut (DC1, DC2) below the respective locking strip (LV1, LV2) enabling the corresponding portion of the secondary flap to be disengaged and the strip to be pushed into the double slit (F11, F21) or (F12, F22) of the assembled main flaps (VP1, VP2).

10. Folding box according to claim 5, characterised in that the base (FD) is in the form of a rectangle, the large sides of which correspond to the folding lines (LP1, LP2) of the main flaps (VP1, VP2).

* * * * *